US005397855A

United States Patent [19]

Ferlier

[11] Patent Number: 5,397,855

[45] Date of Patent: Mar. 14, 1995

[54] LOW NOISE CABLE

[75] Inventor: Jean-Pierre Ferlier, Yerres, France

[73] Assignee: Filotex, Draveil, France

[21] Appl. No.: 117,710

[22] Filed: Sep. 8, 1993

[30] Foreign Application Priority Data

Sep. 8, 1992 [FR] France ..... 92 10708

[51] Int. Cl.[6] ..... H01B 7/34

[52] U.S. Cl. ..... 174/36; 174/102 SC; 174/106 SC; 174/110 FC; 174/120 SC

[58] Field of Search ..... 174/36, 162 SC, 120 SC, 174/116 FC, 106 SC, 106 R

[56] References Cited

U.S. PATENT DOCUMENTS

| | | | |
|---|---|---|---|
| 4,536,327 | 8/1985 | Ramisse et al. | 252/511 |
| 4,565,594 | 1/1986 | Kuettner | 174/102 R |
| 4,915,889 | 4/1990 | Procida et al. | 174/102 SC |
| 5,214,243 | 5/1993 | Johnson | 174/36 |

FOREIGN PATENT DOCUMENTS

| | | | |
|---|---|---|---|
| 204410 | 7/1955 | Australia | 174/102 SC |
| 2484688 | 12/1991 | France . | |
| 2117247 | 10/1971 | Germany | 174/102 SC |
| 2051268 | 5/1972 | Germany | 174/102 SC |
| 2723488 | 11/1978 | Germany . | |
| 2502213 | 10/1990 | Japan | 174/102 SC |
| 2229313A | 9/1990 | United Kingdom . | |

OTHER PUBLICATIONS

Japanese Patent Abstract JP 1239710–Sep. 25, 1989.

*Primary Examiner*—Morris H. Nimmo

*Attorney, Agent, or Firm*—Sughrue, Mion, Zinn, Macpeak & Seas

[57] ABSTRACT

The cable includes a conductive coating layer disposed on an internal dielectric and surrounded by a conductive screen. The cable is characterized in that said conductive coating is a conductive silicone coating and in that the dielectric is treated and therefore has an adapted surface tension value greater than a value typically in current use, therefore directly giving said silicone coating layer a small level of adherence to said treated dielectric and thereby rendering it peelable.

Applicable to cables having operating temperatures of the order of 250° C. and high noise immunity.

3 Claims, 1 Drawing Sheet

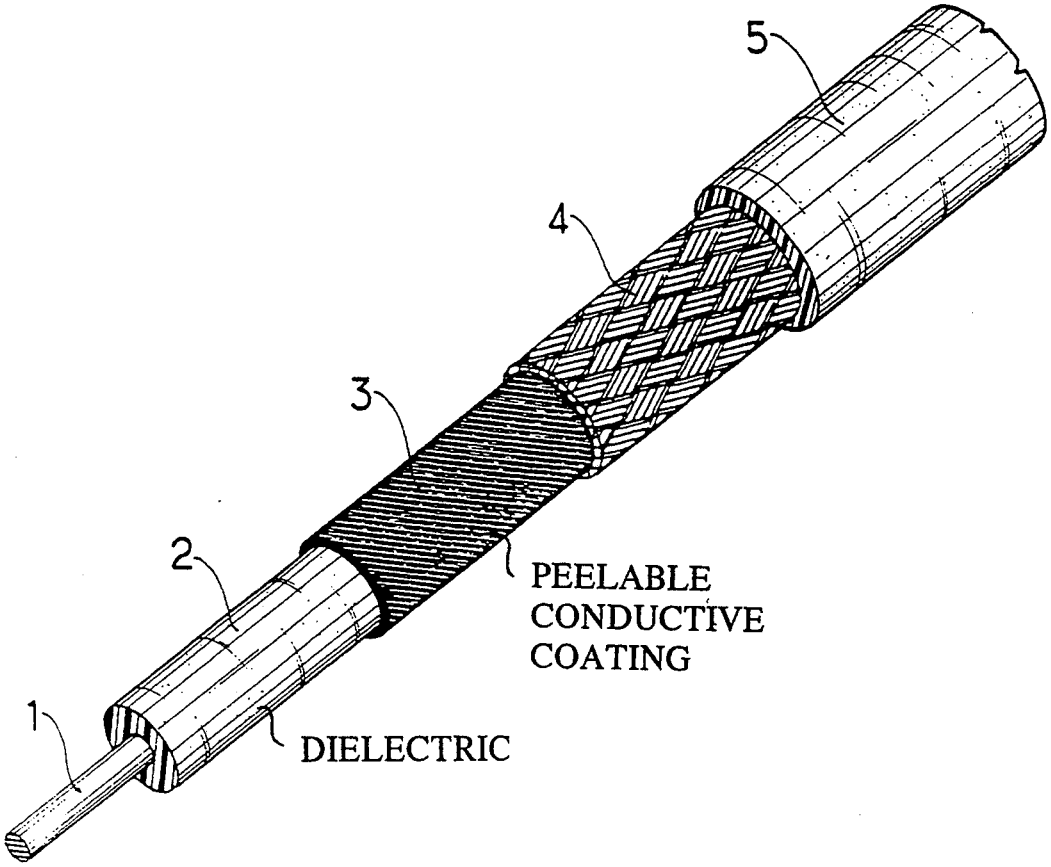
5
4
3
2
1
PEELABLE
CONDUCTIVE
COATING
DIELECTRIC

LOW NOISE CABLE

BACKGROUND OF THE INVENTION

The present invention relates to low noise cables with operating temperatures of the order of 250° C.

Such cables are screened. They comprise a conductive core covered with a PTFE dielectric, a conductive layer arranged on the dielectric and covered with a screen, and a protective external insulating sheath covering the screening. The conductive layer combined with the screening provides improved protection, particularly against low frequencies, for which the cable is said to be anti-noise.

This screening is generally constituted by a braid of conductive wires, particularly wires of bare, nickel-plated or silver-plated copper. For its part, the conductive layer is constituted by a conductive tape or preferably by a conductive varnish, the latter providing better noise immunity to the cable than the tape.

Conductive varnishes are coatings comprising a PTFE based polymer filled with fine conductive particles; they therefore adhere very strongly to the dielectric and provide the desired low level of noise.

However, such conductive coatings are difficult to remove locally at and in the immediate vicinity of the ends of the cables which are provided with connectors. Such removal makes it possible to avoid degradation of the coating at these locations, which degradation is due to vibrations and rubbing that may cause the conductive particles of the coating to become detached and move, thereby causing a short-circuit between the core and the screening in the connectors.

These conductive PTFE based coatings are insoluble in most common solvents. They are removed locally essentially by mechanical means, particularly by scraping or abrasion. This operation is lengthy and difficult, but above all the desired removal is not perfect and may therefore still lead to the risks indicated above.

SUMMARY OF THE INVENTION

An object of the present invention is to reduce the adherence of conductive coatings to the dielectric of such a cable so as to render them peelable and therefore quick and easy to remove locally, whilst still obtaining the desired low level of noise.

The invention provides a low noise cable, with an operating temperature of the order of 250° C. comprising a conductive core, a dielectric of PTFE type surrounding said core, a conductive coating layer covering said dielectric, a conductive screen surrounding said coating layer, and a protective external insulating sheath surrounding said screening, the cable being characterized in that said conductive coating is a conductive silicone coating and in that the dielectric is "treated" and under these conditions has a surface tension of an "adapted" value, substantially greater than a value typically in current use, therefore directly giving said silicone coating layer a limited level of adherence to said treated dielectric and thereby rendering it peelable.

Moreover, said cable has at least one of the following additional features:

said treated dielectric has an adapted surface tension value substantially in the range 30 dynes/cm to 40 dynes/cm at a temperature of the order of 20° C.;

said conductive silicone coating is based on a polysiloxane type of polymer, and is filled with fine particles of carbon black.

The features and advantages of the present invention will be apparent from the description which follows with reference to the single accompanying drawing.

BRIEF DESCRIPTION OF THE DRAWING

This single FIGURE illustrates by way of example a screened low noise cable of the invention, with an operating temperature of about 250° C.

DESCRIPTION OF A PREFERRED EMBODIMENT

This cable comprises a conductive core 1, a dielectric 2 surrounding the core, a peelable conductive coating layer 3 covering the dielectric, a high conductivity metal screen 4 surrounding the conductive coating, and an external insulating sheath 5 covering the screening and protecting the cable.

The dielectric is a polytetrafluoroethylene (PTFE) or one of its co-polymers.

The conductive coating is a silicone coating based on a polysiloxane type of polymer and filled with fine particles of carbon black.

Examples of conductive coatings of this type may be found in the compositions disclosed in document FR-A 2484688 (corresponding to U.S. Pat. No. 4,536,327) and recommended in that document for protecting electrical links which may be exposed to X-rays. In particular, a composition of that known type is formed of the following proportions of the materials indicated below:

100 parts by weight of the polymer (silicon elastomer) known by the trademark "Rhodorsil" registered by the company Rhône-Poulenc and sold under the reference RTV 141 A, 10 parts by weight of a cross-linking agent the material known by the preceding trademark "Rhodorsil" and sold under the reference RTV 141 B, 15 parts by weight of carbon black known by the trademark "Ketjenblack" registered by the company Akzo and sold under the reference EC 300 J, and 400 parts by weight of pure toluene, which acts as a solvent for applying the composition to the dielectric of the cable.

In the present invention, the strong natural adherence of the conductive coating to the dielectric, as obtained in prior art cables, is reduced to a limited value, so that the coating may be peelable whilst still adhering sufficiently to the dielectric and whilst not suffering substantial degradation in its electrical characteristics.

This desired limited adherence is obtained without adding an agent for that purpose to the conductive coating, but firstly by selecting a conductive silicone coating instead of a conductive PTFE coating, and secondly by surface treatment of the dielectric 2, which gives rise to a significant increase in the surface tension of that dielectric for application of the conductive silicone coating thereto. By this treatment, the surface tension of the dielectric, which in prior art cables is typically of the order of 20 dynes/cm at 20° C., is raised to a value in the range 30 dynes/cm to 40 dynes/cm at 20° C. Without this treatment of the dielectric, the adherence of the conductive silicone coating is virtually zero and the desired noise immunity would not be obtained.

The conductive silicone coating deposited under these conditions is preferably of a minimum thickness of 50 microns, so as to present sufficient mechanical strength to withstand the pressure exerted by the wires of the screening braid which covers it. The resistivity of the coating lies in the range 1 ohm.cm to 10 ohm.cm at 20° C.

This conductive silicone coating layer is therefore readily separated from the dielectric wherever required, simply by peeling with the finger-nail or some other means, so as to locally remove the coating without leaving any traces of conductive material on the dielectric in that region.

The cable of the invention is therefore protected in a particularly effective manner against external electromagnetic interference, and also against noise generated in the cable itself or in the electric or electronic circuits which it links together, this protection being given by its screening and by its underlying uniform conductive silicone coating layer. The noise level obtained is less than 100 microvolts. Moreover, the cable is free from the risk of short-circuits at its connectors, such risks being rendered almost non-existent even under the severe operating temperature and vibration conditions of said cable, this being due to the possibility of complete removal of the conductive silicone coating at these locations and therefore the absence of conductive filler particles which could become detached from the coating.

I claim:

1. A low noise cable, with an operating temperature of the order of 250° C., comprising a conductive core, a dielectric of PTFE type surrounding said core, a conductive coating layer covering said dielectric, a conductive screen surrounding said coating layer, and a protective external insulating sheath surrounding said screening, the cable being characterized in that said conductive coating is a conductive silicone coating and in that the dielectric is treated and under these conditions has an adaptive surface tension value substantially in the range 30 dynes/cm to 40 dynes/cm at a temperature of the order of 20° C., therefore directly giving said silicone coating layer a limited level of adherence to said treated dielectric and thereby rendering it peelable.

2. A cable according to claim 1, characterized in that said conductive silicone coating is based on a polysiloxane type of polymer, and is filled with fine particles of carbon black.

3. A cable according to claim 1, characterized in that said conductive silicone coating comprises, in parts by weight, substantially 100 parts of a silicone elastomer, 10 parts of a cross-linking agent and 15 parts of fine particles of carbon black.

* * * * *